US005842826A

United States Patent [19]

Owen et al.

[11] Patent Number: 5,842,826

[45] Date of Patent: Dec. 1, 1998

[54] SHEET DELIVERY APPARATUS FOR A PRINTER

[75] Inventors: David Owen, Stevenage; David Maple; Robert Clifford Gaskell, both of Baldock; Brian George Elsey; John Leslie Handscombe, both of Beds, all of United Kingdom

[73] Assignee: Xerox Corporation, Stamford, Conn.

[21] Appl. No.: 827,349

[22] Filed: Mar. 26, 1997

[30] Foreign Application Priority Data

Apr. 13, 1996 [GB] United Kingdom ..... 9607761

[51] Int. Cl.[6] ..... B65H 31/30

[52] U.S. Cl. ..... 414/789.9; 271/3.03

[58] Field of Search ..... 271/3.03; 414/789.9, 414/790.2, 790.7

[56] References Cited

U.S. PATENT DOCUMENTS 4,750,853 6/1988 Van Soest et al. ..... 414/789.9

4,826,383 5/1989 Miller ..... 414/789.9

*Primary Examiner*—Janice L. Krizek

[57] ABSTRACT

A sheet delivery apparatus (10) in the form of an accessory adapted to be secured to a printing machine (11). The apparatus comprises a sheet receiver (12) arranged to co-operate with the printing machine to receive one or more sheets output by the printing machine, and sheet delivery system (18, 19) for presenting the one or more sheets to a user, the sheets being partially fed by the sheet delivery means through a security gate and deflector system to enable removal of the sheet or sheets by the user. The sheet delivery system is controlled so as to withdraw sheets from access by the user if the sheets have not been removed after a predetermined time has elapsed and to deflect them into an internal secure bin, with the security gate and deflector system being provided by a dual function dual position shutter and deflector member.

5 Claims, 8 Drawing Sheets

SHEET DELIVERY APPARATUS FOR A PRINTER

Figure 1:
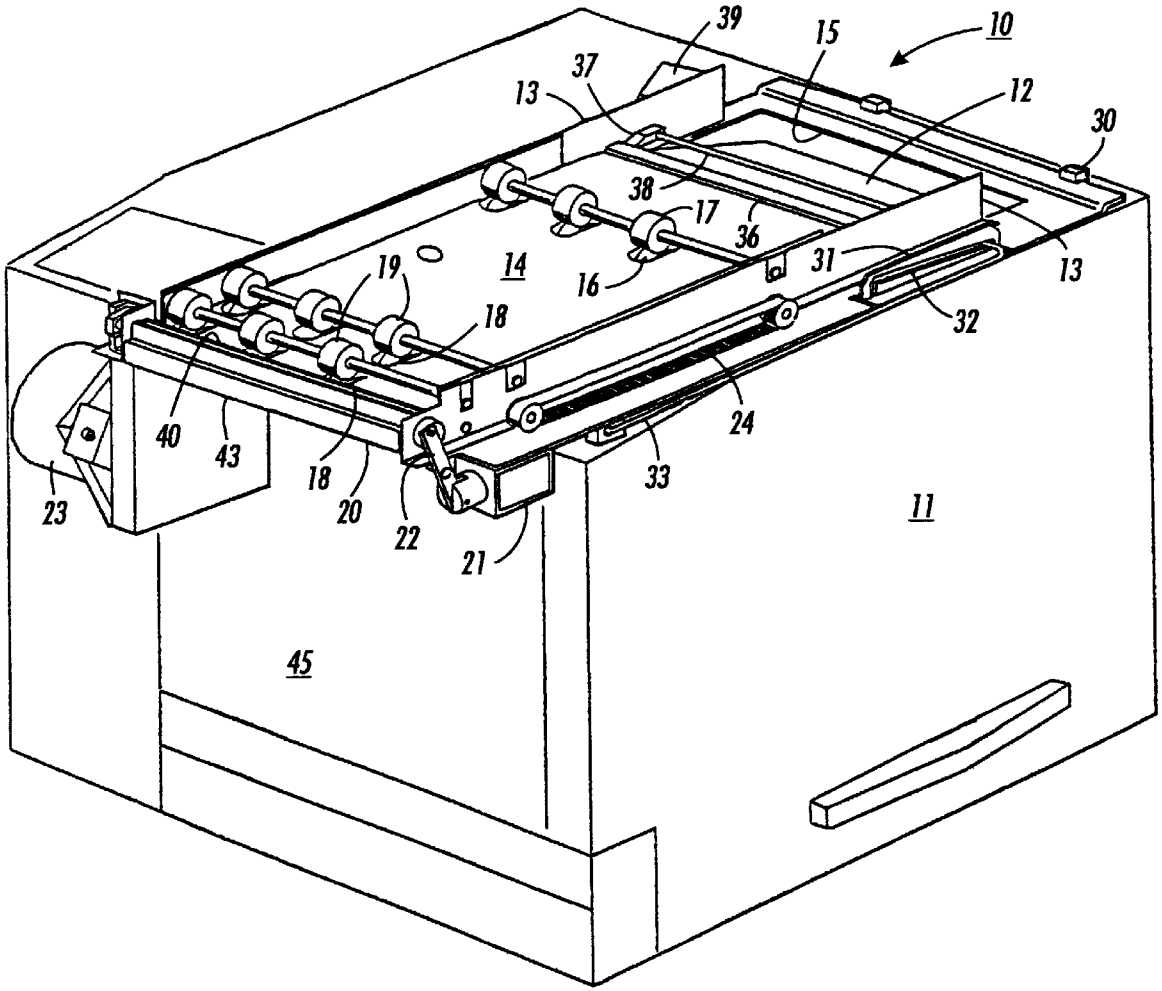

Priority is claimed from UK Patent Application No. 9607761 filed Apr. 13, 1996.

This invention relates to a sheet delivery apparatus which is particularly useful as a sheet set presenter in an automated system for delivering printed sheets to a user with improved security.

Sheet delivery apparatus of many different kinds are known, such as those found in copying or printing machines, and those in self-service cash dispensers. Many self-service banking/cash machines contain means for printing information on demand, such as simple details of transactions plus account information. The printing mechanism is usually a character printer which can only print alphanumeric characters and very simple low resolution representations of graphics. The printer technology is usually dot matrix.

These self-service banking/cash machines include the well known "ATMs" or "money machines". They typically have a system for partially extending the bills or currency, if any, and then partially extending both the printed transaction slip, and the user's magnetic stripe plastic access card back out of the machine after the transactions made with it are completed, for user removal, and also for thereafter retracting the user's card back into the machine for storage if the user forgets to take it, that is, leaves the card partially extending from the machine for too long after the transaction is completed.

There is a demand for more versatile printing facilities in such a self-service machine, for instance, printing a high quality facsimile of checks that have been paid into the machine as a record of receipt. This requires a printing mechanism that is able to print relatively high resolution graphical data, not just alphanumeric data. There is also a demand for a printing mechanism that is able to print more general information, for instance, promotional literature. Furthermore, it would be desirable to be able to print and deliver, on demand, negotiable documents such as gift vouchers, or checks, which could be travelers checks. With many of these desired applications, the output may often comprise more than one sheet, that is, plural sheet sets, and also different sheet sizes may be required from the same printing mechanism. It is also desirable to be able to use as the low cost printing mechanism a simple printer driven by a PC, a commercially available the desk-top 'PC' printer, particularly the laser printer or ink jet printer.

If, however, the printer is required to be in a self-service machine that is providing negotiable documents on demand, the printing mechanism needs to be in a secure environment inside the self-service machine, and also the printed output needs to be delivered not as a series of sheets one after the other, but as a complete job or set.

It is a feature of the disclosed embodiment to provide a sheet delivery apparatus which meets these and other needs at low cost. There is disclosed a sheet delivery apparatus adapted to be secured to a printing machine and comprising a sheet receiver arranged to co-operate with the printing machine to receive one or more sheets output by the printing machine, sheet delivery means for presenting the one or more sheets to a user, the sheets being partially fed by the sheet delivery means to enable removal of the sheet or sheets by the user, and control means for controlling the sheet delivery means to withdraw sheets from access by the user if the sheets have not been removed after a predetermined time has elapsed.

There is also disclosed a system for delivering documents to a user comprising a printing machine, a user interface, and a sheet delivery apparatus according to the preceding paragraph, the sheet delivery apparatus being secured to the printer, and the user interface including means to enable the user to instruct the system to deliver sheets. The disclosed apparatus desirably may be in the form of an accessory or add-on unit, which enables a standard printer, such as a laser printer, to be used substantially unmodified in a self-service machine for printing and delivering negotiable documents.

Figure 2:
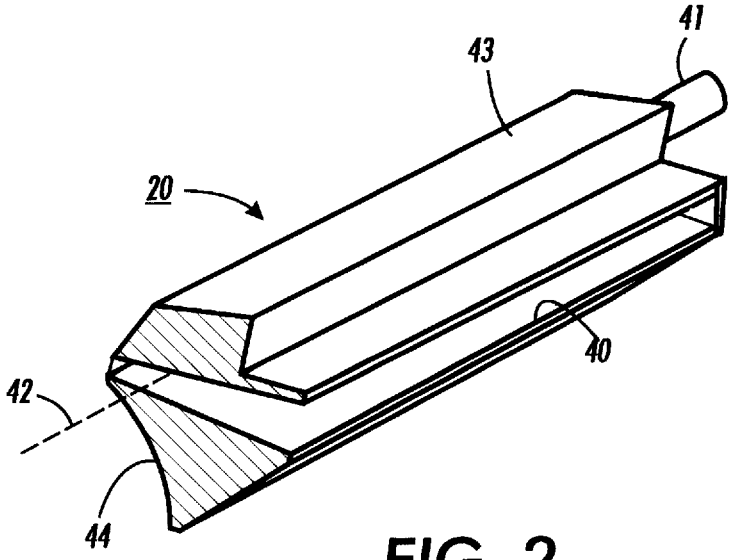
Figure 5:
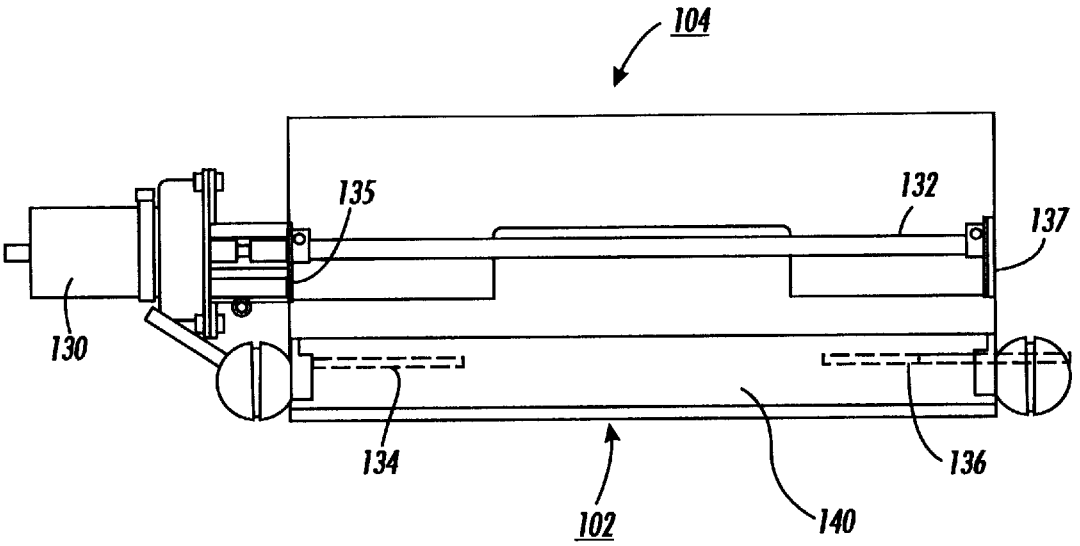
Figure 3:
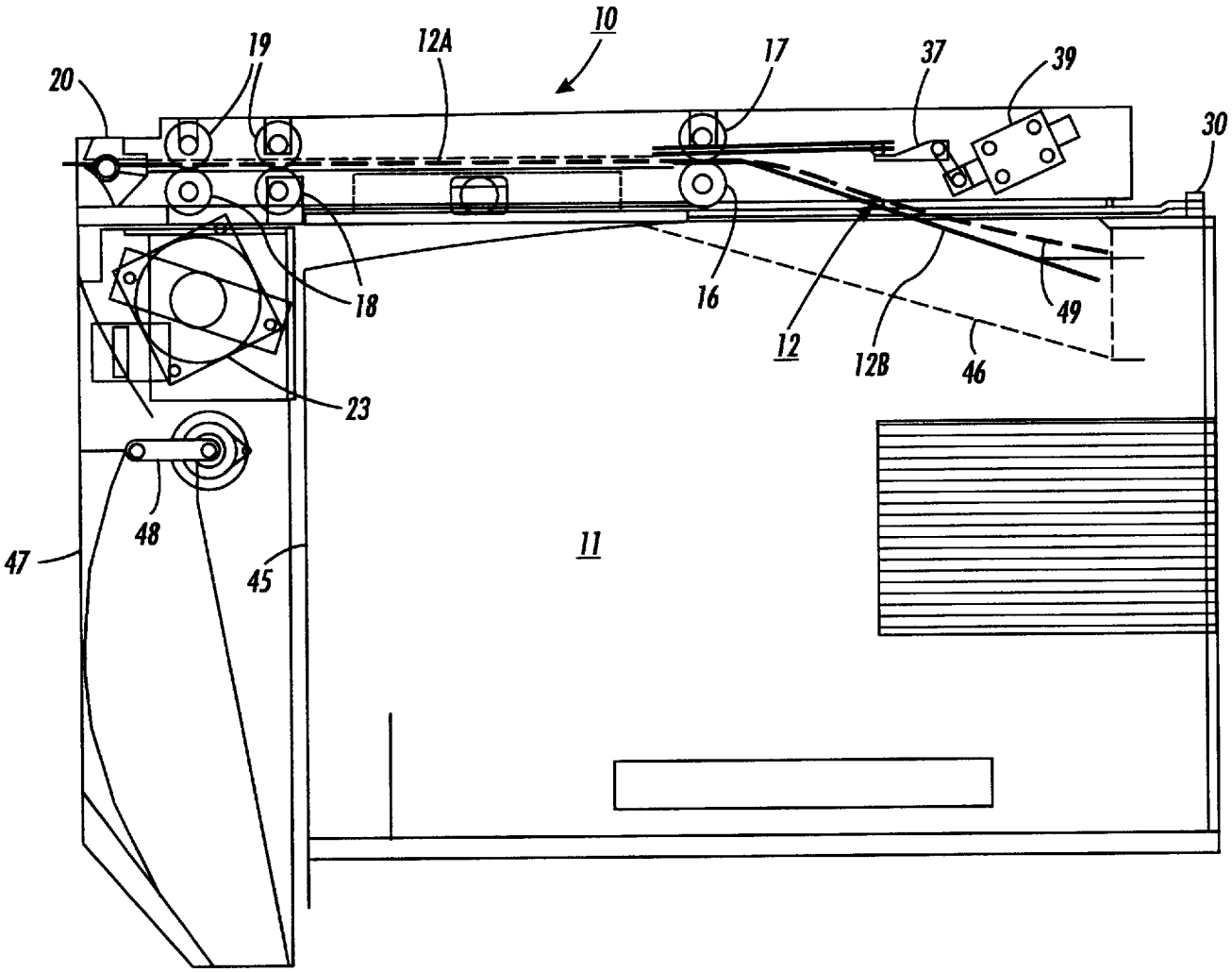
Figure 4:
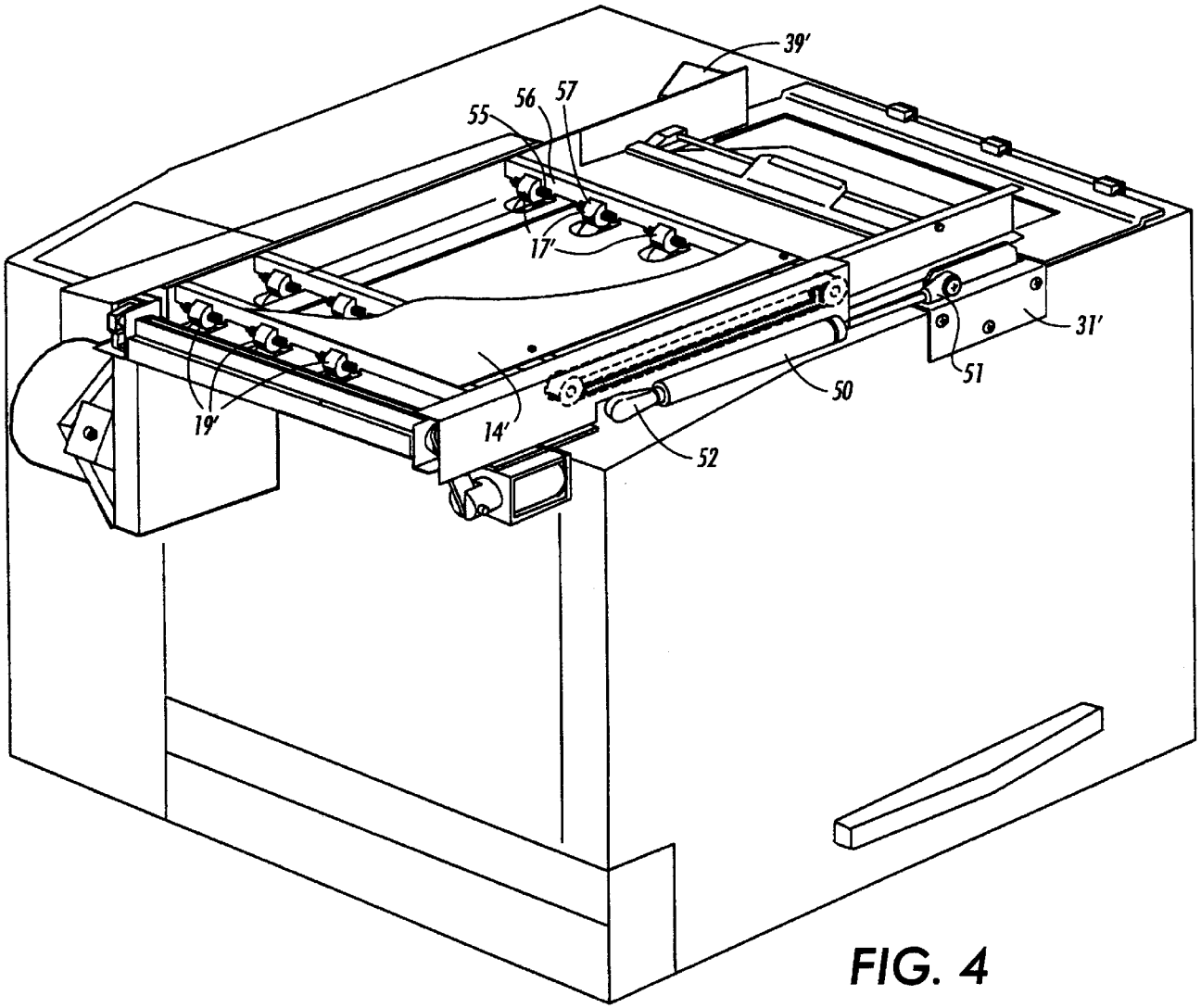
Figure 6:
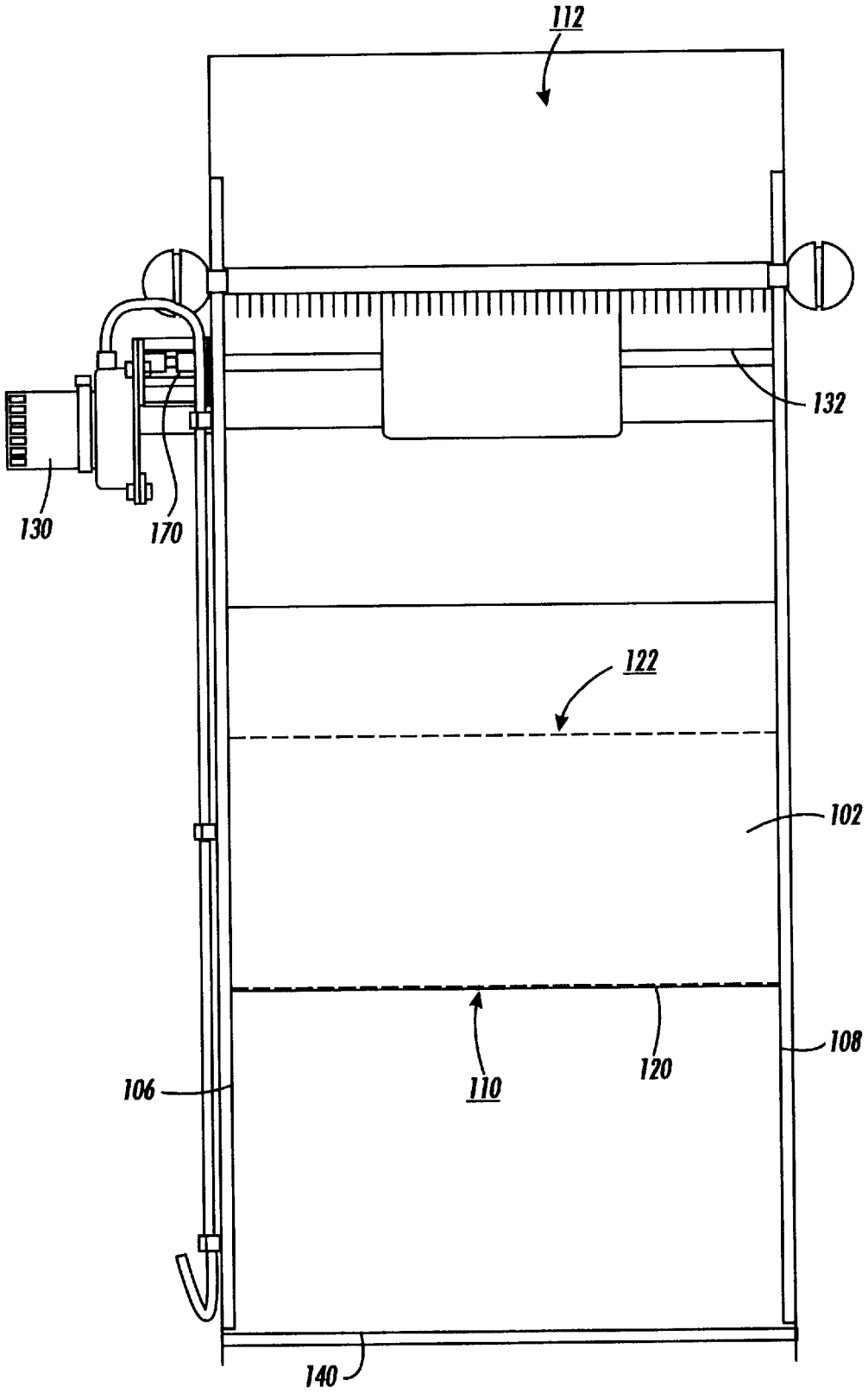
Figure 7:
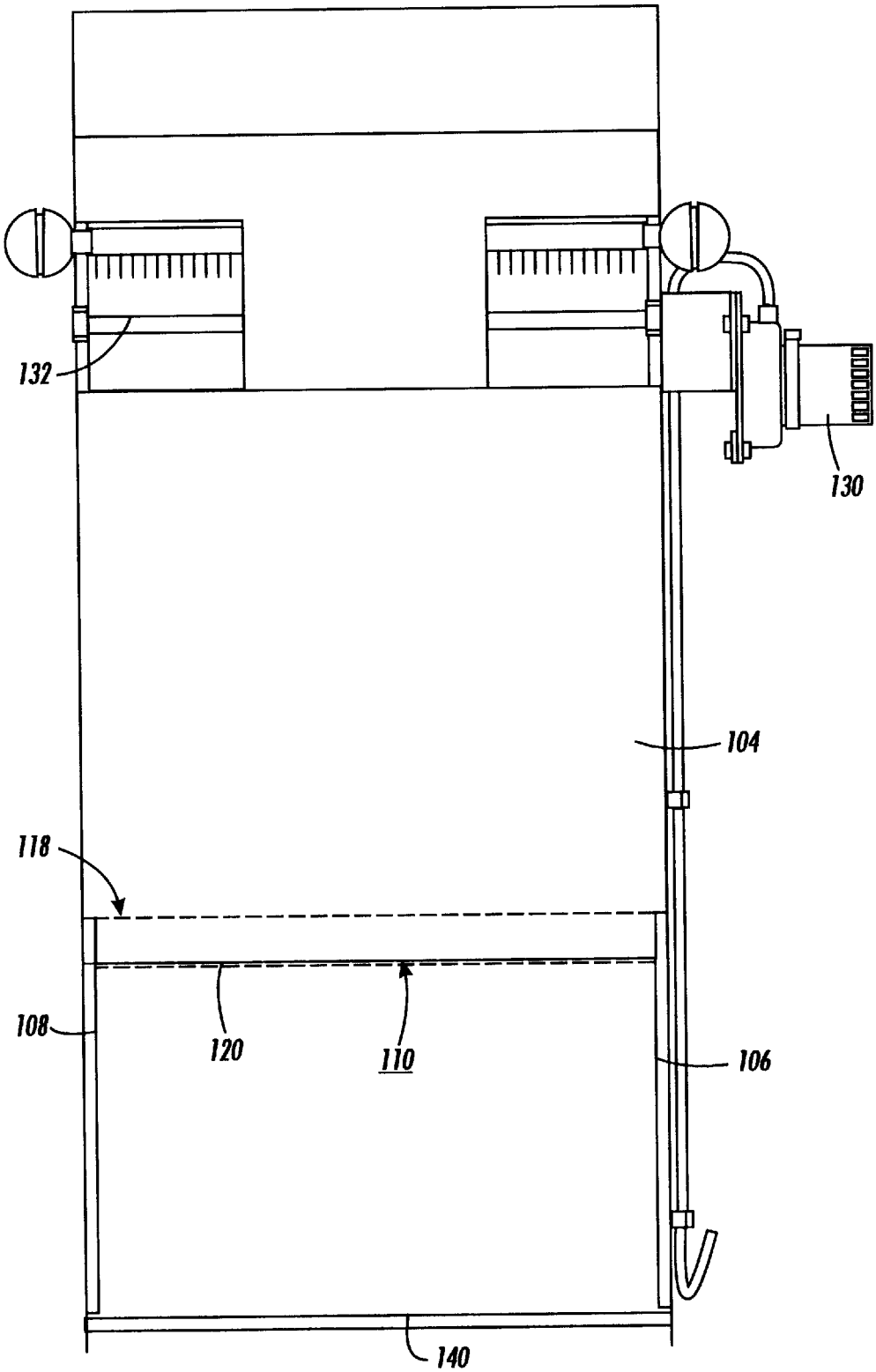
Figure 8:
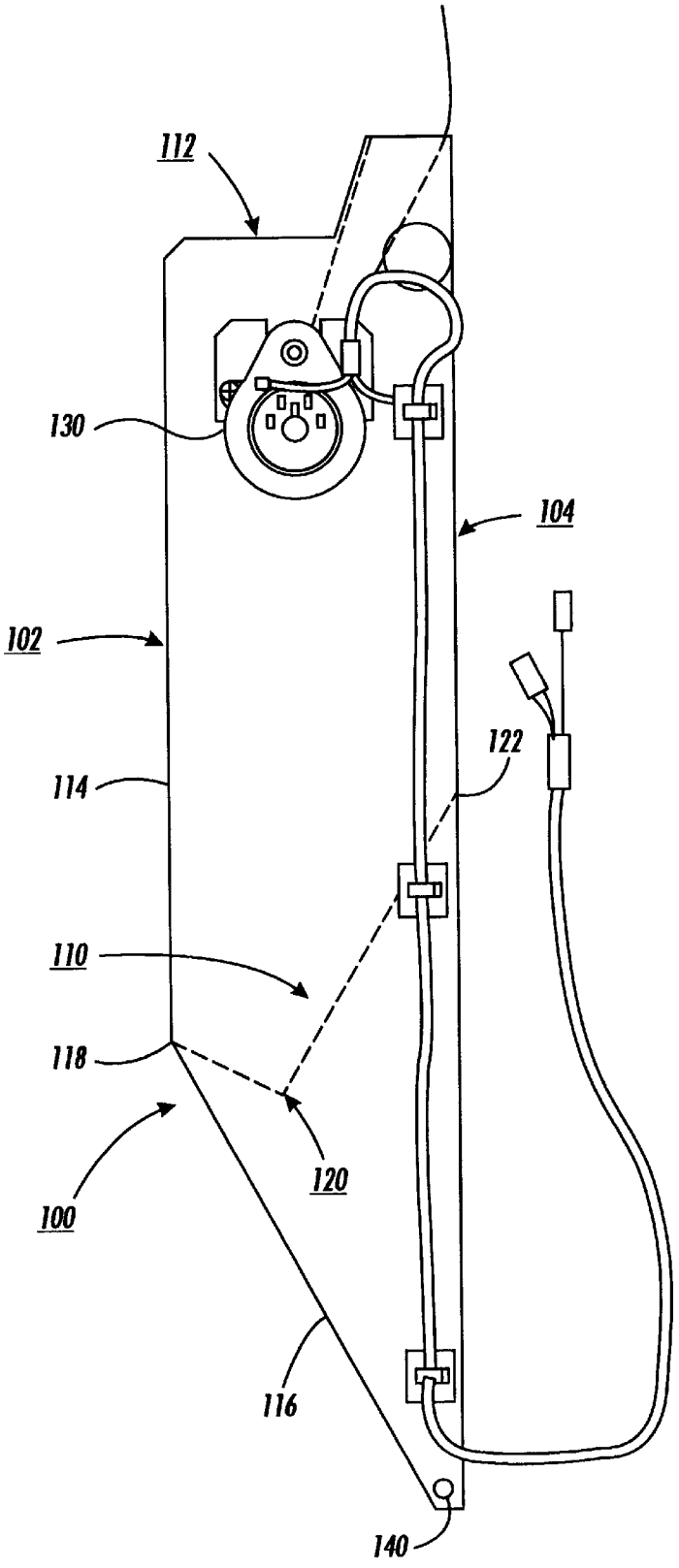
Figure 9:
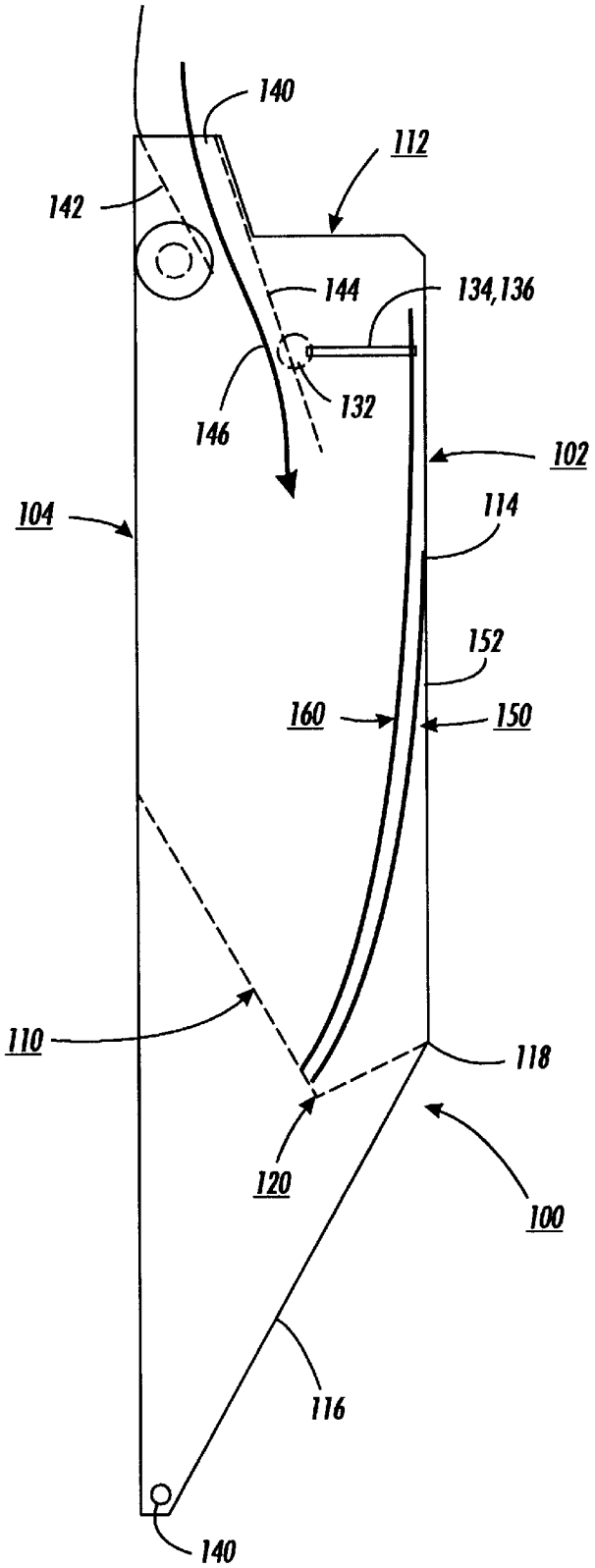

Further features and advantages will be apparent from the following description of two examples of a subject sheet delivery apparatus, operatively connected to an exemplary printer, in accordance with the invention, with reference to its accompanying drawings, in which:

FIG. 1 is a perspective view of one embodiment of the apparatus of the invention, shown as secured to the exemplary laser printer;

FIG. 2 is a cross-sectioned perspective view of a shutter forming part of the apparatus of FIG. 1; and FIG. 3 is a cross-sectional side view of the apparatus of FIG. 1, showing in dashed lines the path of sheets through the apparatus, FIG. 4 is a perspective view of another embodiment of the apparatus of the invention, secured to a laser printer, FIG. 5 is top view of an auxiliary sheet store for use with the sheet delivery apparatus of the present invention, FIG. 6 is a front view of the sheet store of FIG. 5, FIG. 7 is a rear view of the sheet store of FIG. 5, and FIG. 8 and FIG. 9 are side views of the sheet store of FIG. 5.

Referring now to FIGS. 1 and 3, an exemplary sheet delivery apparatus 10 is shown, mounted on the top of a conventional small laser printer 11. The sheet delivery apparatus 10 is a self contained unit which is adapted to simply engage and be secured to the printer 11, so as to locate the sheet delivery apparatus in the correct position to receive sheets output by the printer. The printer is preferably a standard, unmodified, printer such as a Xerox® 4517 laser printer. As one example of a way to secure the sheet delivery apparatus 10 to a printer 11 of this kind, here an existing blanking plate (not shown) at the rear of the machine 11 is removed, and a mounting plate bolted on in its place. The mounting plate here carries upstanding pivot supports 30. In addition, a bracket 31 may be fixed to the top of the printer by any suitable means (not shown). The bracket 31 has a slot 32 for receiving a stay bar 33 which is pivotally mounted at the front of the apparatus 10, so that the complete apparatus can be lifted, at its front end, by pivoting about the pivot supports 30, to provide access to the printer 11.

The sheet delivery apparatus 10 here includes a base plate 12 and upstanding side walls 13, which between them support a sheet retainer 14 for sheets outputted by the printer 11. The base plate 12 has a horizontal front portion 12*a* and a rear portion 12*b* which slopes downwardly towards the back of the apparatus and which is located over the normal sheet receiving tray 46 (FIG. 3) of the printer. Sheets outputted from the printer enter the sheet delivery apparatus 10 through a cut-out portion 15 at the rear of the sheet delivery apparatus. The sheet retainer 14 may be pivotally mounted at its front edge about pivot points (not shown), and can be lifted at its rear end 36 by a lifting mechanism comprising levers 37 secured to an axle 38, actuated by a solenoid 39.

When sheets are to be delivered by the printer, the rear end of the sheet retainer 14 is lifted, by actuation of the solenoid 39, so that sheets settle between the base 12 and the underside of the sheet retainer 14. Once a complete set of printed sheets has been collected, and is ready to be delivered to the user, the sheet retainer 14 is lowered. The stack of sheets is then engaged by drive rolls 16 and co-operating idler rolls 17 mounted in the sheet retainer 14, to drive the sheets forward to two sets of delivery rolls 18, which cooperate with idler rolls 19 mounted at the front end of the sheet retainer 14. Idler rolls 17, 19 are mounted on respective shafts and are free to rotate as shown in FIG. 1. As the sheets are driven forwards by the delivery rolls 18, 19, a shutter 20, shown in more detail in FIG. 2, is operated by pivoting it to align a slot 40 with the sheet path by means of a solenoid 21 and pivoted arm mechanism 22. The shutter 20, which may be for example of nylon or metal, is formed, as indicated in FIG. 2, with the slot 40 extending across almost the full length of the shutter, and with the slot tapering in the sheet feeding direction. Axles 41 are formed on the ends of the shutter, to enable it to pivot about the axis 42. When the shutter 20 is in its closed position, the slot 40 is oriented substantially vertically (as seen in FIG. 1) and the outer face 43 of the shutter is adjacent the slot (not shown) in the outer or security housing (also not shown) through which documents are delivered to the user. Furthermore, the inner face 44 of the shutter, opposite the outer face 43, is of concave section so that when the shutter is in its closed position, any sheets that are driven towards it by the delivery rolls 18, 19 are deflected downwards over the front face 45 of the printer 11.

With the shutter 20 in its open position, sheets for delivery to the user are driven forward so that the leading edges of the set of sheets project a short distance beyond the shutter 20, at which point the delivery rolls 18, 19 are stopped, so that the set of sheets can be grasped and removed by the user. The drive rolls 16 and delivery rolls 18 are driven by a stepper motor 23, acting through first drive belts (not shown) between the motor and the delivery rolls 18, and through a second belt 24 between the delivery rolls 18 and the drive rolls 16. The path of sheets through the apparatus is shown by the dashed or broken line 49 in FIG. 3.

The electronic components to operate the apparatus 10 may be provided on a circuit board (not shown) mounted beneath the base 12 of the apparatus. The apparatus does not require any connection of mechanical drives to the printer, but it does require electrical power, and electrical connections to the user interface.

The printer 11, with the sheet delivery apparatus attached, is mounted in a secure environment within a self-service machine, with a slot (not shown) adjacent the shutter 20 through which sheets can be delivered to the user. At all times except when sheets are being presented to the user, the shutter 20 remains in its 'closed' position, as shown in FIG. 1.

The operating circuits of the apparatus include a control means which controls the sheet delivery rolls such that if the sheets are not removed by the user within a predetermined time period, the delivery rolls are driven backwards, thereby withdrawing the sheets into the sheet receiver 14, and at the same time closing the shutter 20. Once the sheets have been withdrawn to a predetermined position, they are fed forwards again, to be diverted by the concave face 44 of the shutter, downwardly over the front of the printer. An auxiliary sheet store 47 attached to the front end of the sheet delivery apparatus, and positioned in front of the printer 11, is arranged to catch the withdrawn sheets, as shown in FIG. 3. The auxiliary sheet store 47 may be a passive device, for example a substantially empty box, or it may include active components such as drive rollers or a tamping device 48 (driven by the motor 23) to enable orderly stacking of withdrawn documents.

It will readily be appreciated that the sheet delivery apparatus discussed above with reference to FIGS. 1 to 3 is not limited to the specific components described. Other components may be used which carry out the same functions. For example, in FIG. 4, another embodiment of the sheet delivery apparatus is shown in which the bracket 31' and stay bar 33 arrangement is replaced with a gas spring 50. One end 51 of the gas spring 50 is pivotably mounted on bracket 31' and the other end thereof is attached to the side rail of base plate 12. In this embodiment, the idler rolls 17', 19' are individually mounted on springs 55 carried by a plate 56. The idler rolls 17', 19' are located in slots 57 cut in the plate 56 as shown. Additionally, sheet retainer 14' is normally spaced from base plate 12 and solenoid 39' is activated to lower the sheet retainer 14' to bring the idler rolls 17' into contact with drive rolls 16 so that the sheets can be driven towards the delivery rolls 18 and their associated idler rolls 19'.

In summary, in the use of either version this apparatus, one or more sheets to be delivered to a user are outputted by the printer, to collect in the space between the base 12 and the underside of the sheet retainer 14 or 14'. The sheet retainer 14 or 14' then drops, allowing the idler rolls 17 or 17' and 19 or 19' to engage the drive rolls 16 and delivery rolls 18, so that any sheets between them are driven forwards to be delivered to the user through the slot 40 in the shutter 20 (which has just been moved to its open position). If the user removes the documents, the shutter returns to its closed position after a predetermined time. If the user does not remove the documents within a predetermined time, as detected by the continued presence of an output signal from a sheet sensor (not shown) adjacent the delivery rolls, then the delivery rolls are driven in reverse to withdraw the partially fed sheet or stack of sheets. The shutter 20 then closes, and the sheet or stack is driven forwards again, this time to be deflected by the concave face 44 of the shutter 20, to be collected in the auxiliary sheet store 47.

FIGS. 5 to 9 illustrate an exemplary auxiliary sheet store 47 in more detail. The sheet store 47 here comprises a bin 100 which comprises a front wall 102, a back wall 104, a pair of side walls 106, 108, a base 110 and a top 112 as shown. The front wall 102 is shaped to have a substantially vertical portion 114 and a sloping portion 116, which meet along line 118. The base 110 is shaped so that it extends generally downwards from line 118 in the front wall 102 to a vertex 120 and then generally upwards to join back wall 104 at line 122.

A motor 130 is mounted towards the top of side wall 106 as shown and is connected to a shaft 132 which extends the width of the bin 100. The shaft 132 carries a pair of paddles 134, 136 at either end thereof, as shown, which are rotated with the shaft 132 by the motor 130. The paddles 134, 136 take the form of single-pronged forks about 5 cm long which extend parallel to the shaft 132 and are attached to shaft 132 by respective arms 135, 137. In their rest position, the paddles 134, 136 are positioned adjacent front wall 102.

The top 112 of the bin 100 has an opening 140 through which sheets which have been rejected by the apparatus 10 can pass into the bin 100. The opening 140 is defined by deflector plates 142, 144 which guide the sheets, in the direction indicated by arrow 146, towards the base 110 of the bin 100 between the shaft 132 and the paddles 134, 136.

The base 110 of the bin 100 is shaped so that small sheets 150 (typically less than A4 size) will fall into vertex 120 and lay forwards with their top ends 152 against front wall 102 beneath paddles 134,136.

The motor 130 is controlled by the apparatus 10 and is energized each time sheets are rejected from the apparatus 10 and passed into the bin 100. The motor 130 rotates shaft 132 through 360° in a predetermined time—typically, a few seconds (for example, 3 seconds). The paddles 134, 136 also rotate with the shaft 132 through 360° contacting the rear of A4 sheets 160 stacked in the bin 100 to push them forwards against front wall 102 and to retain them there. This ensures that the opening 140 is not impeded by sheets and allows succeeding sheets to drop unimpeded into the bin 100.

It will readily be appreciated that the combination of the shape of the base 110 of the bin and the action of the paddles 134, 136 prevents succeeding sheets entering the bin 100 catching on the top edges of sheets already present therein.

As the bin 100 becomes full, a sheet or a set of sheets will fail to drop to the base 110 thereof. When this happens, the rotation of the paddles 134, 136 is impeded. A sensor 170 is positioned to check for the paddles 134, 136, and if the shaft 132 is unable to complete its 360° rotation within the predetermined time, the sensor 170 indicates to the apparatus 10 that the bin 100 is full after a time delay of, for example, 4 s.

As mentioned previously, the base 110 of the bin 100 is designed so that the top edges (i.e. the trailing edges) of printed sheets are induced to fall outwards towards the front wall 102 of the bin 100. After each set of sheets (which may also be a single sheet) is driven into the bin by the delivery rolls 18 and their co-operating idler rolls 19, the motor 130 is energized to ensure that the top edges of the sheets lie against front wall 102, thereby overcoming the problem of sheets catching sheets already in the bin. The bin 100 also overcomes the considerable curl which may be imparted to the sheets during the printing process. This is a particular problem when the paper is thin.

It is desirable that the auxiliary sheet store 47 be pivotably mounted with respect to the sheet delivery apparatus 10 to provide access to the printer 11. In the embodiment described above, the store 47 may be pivoted about bar 140 which extends across the bottom thereof through side walls 106, 108 as shown in FIGS. 6, 7, 8 and 9, that is, the top 112 can be pivoted generally downwards. In another embodiment (not shown), the store 47 may be pivoted about one of its side walls, for example, about side wall 108. In this case, motor 130 on side wall 106 could be relocated to other suitable positions and the drive to paddles 134, 136 could be indirect, for example, by means of pulleys, gears or belts (not shown).

Further variations and alternatives will be apparent to those skilled in the art and are intended to be encompassed by the following claims:

What is claimed is:

1. A security sheet delivery apparatus adapted to be secured to a sheet printing machine comprising:

a secure sheet receiver arranged to cooperate with said printing machine to receive and secure a set of a plurality of sheets outputted by said printing machine, a sheet delivery system for presenting said plural sheets set for unsecured access to a user from said secure sheet receiver upon receipt of a sheet delivery control signal, said sheet delivery system partially feeding out the plural sheets set from said secure sheet receiver to enable unsecured removal of the plural sheets set by the user, said sheet delivery system being reversible to withdraw said plural sheets set from access by the user if the set has not been removed after a predetermined time has elapsed; and a security closure system with an exit slot through which said plural sheets set is presented for access to the user, said security closure system including a closure member for closing said exit slot except when said plural sheets set is being presented for access to the user.

2. The security sheet delivery apparatus of claim 1 further including an automatically movable deflector system for deflecting the plural sheets set that has been withdrawn by said reversible sheet delivery system, in automatic cooperation with another reversal of said sheet delivery system.

3. The security sheet delivery apparatus of claim 1 further including an automatically movable deflector system for deflecting the plural sheets set that has been withdrawn by said reversible sheet delivery system; and further including an auxiliary sheet store mounted to receive said plural sheets set that has been withdrawn by said reversible sheet delivery system and deflected by said deflector system.

4. The security sheet delivery apparatus of claim 3, wherein said auxiliary sheet store includes a bin for collecting sheets and a sheet paddling system located in said bin for moving sheets in said bin out of the way of incoming sheets.

5. The security sheet delivery apparatus of claim 3 wherein said automatically movable deflector system comprises a rotatable plural position shutter with a slot through which said plural sheets set is fed in one said rotatable position, said shutter also having an arcuate deflector surface against which said plural sheets are fed to be so deflected in another said rotatable position.

* * * * *